US005706697A

United States Patent [19]

Inada

[11] Patent Number: 5,706,697

[45] Date of Patent: Jan. 13, 1998

[54] PROCESS OF AND APPARATUS FOR IRONING WORK FOR BOLT AND THE SAME WORK FOR BOLT

[75] Inventor: Takeshi Inada, Tokai, Japan

[73] Assignee: Toyota Jidosha Kabushiki Kaisha, Aichi-ken, Japan

[21] Appl. No.: 687,030

[22] Filed: Jul. 25, 1996

[30] Foreign Application Priority Data

Aug. 1, 1995 [JP] Japan ..... 7-196668

[51] Int. Cl.[6] ..... B21D 22/00

[52] U.S. Cl. ..... 72/352; 72/358; 72/352

[58] Field of Search ..... 72/352, 355.2, 72/360, 361, 358, 359; 470/143, 145, 191

[56] References Cited

U.S. PATENT DOCUMENTS

| | | | |
|---|---|---|---|
| 2,030,290 | 2/1936 | Friedman | 470/191 |
| 2,044,986 | 6/1936 | Horton | 470/191 |
| 2,111,046 | 3/1938 | Friedman . | |
| 3,055,102 | 9/1962 | Shaw et al. | 72/325 |
| 3,157,093 | 11/1964 | Shaw et al. | 72/325 |

FOREIGN PATENT DOCUMENTS

| | | |
|---|---|---|
| C-671545 | 2/1939 | Germany . |
| 8-174130 | 7/1996 | Japan . |

*Primary Examiner*—Lowell A. Larson
*Assistant Examiner*—Rodney A. Butler
*Attorney, Agent, or Firm*—Oliff & Berridge

[57] ABSTRACT

A process of ironing a thread formation shaft portion of a work for bolt having a cylindrical portion and the thread formation shaft portion in axial alignment. The process comprises the steps of supporting the cylindrical portion of the work in radial directions and in a zero clearance state, and moving the thread formation shaft portion in the axial direction relative to a shaft portion ironing die, the supporting step and the moving step being executed simultaneously.

2 Claims, 6 Drawing Sheets

PROCESS OF AND APPARATUS FOR IRONING WORK FOR BOLT AND THE SAME WORK FOR BOLT

BACKGROUND OF THE INVENTION

1. Field of the Invention

This invention relates to a process of and apparatus for ironing a work for bolt having a cylindrical portion and a thread formation shaft portion in axial alignment, specifically ironing the thread formation shaft portion, and also to the ironed work.

2. Description of the Prior Art

FIGS. 6(A) and 6(B) show a prior art ironing apparatus pertaining to the invention. This ironing apparatus 1 is used for ironing work w for bolt. The work w has a cylindrical portion wk, a thread formation shaft portion wn, and a connecting portion wt connecting the portions wk and wn. The portions wk, wt and wn are in axial alignment. The apparatus 1 irons the thread formation shaft portion wn of the work w to a predetermined finish diameter. After the thread formation shaft portion wn has been finished to the predetermined diameter, it is formed with a thread, thus completing a bolt.

The ironing device 1 comprises a movable die 2 for guiding the work w while supporting the cylindrical portion wk thereof in radial directions, and an ironing die 4 for ironing the thread formation shaft portion wn.

The ironing die 4 has a land (not shown) for ironing the thread formation shaft portion wn of the work w, and comprises two stages disposed one over another and secured centrally in a substantially cylindrical reinforcement ring 5. The reinforcement ring 5 is accommodated in a cylindrical die case 8, and is positioned with its flange **5*f* clamped in the axial direction between the die case 8 and a die base 6**.

The movable die 2 is slidable through the die case 8 above the reinforcement ring 5, and has a central hole **2*k* for supporting the cylindrical portion wk of the work w in radial directions and coaxially with the ironing die 4. The hole 2*k*** has a slightly greater diameter than the outer diameter of the cylindrical portion wk of the work w.

A pair of spring retainer pins **2*r* are secured to the lower end of the movable die 2 and extend in the sliding direction through guide holes 5*h* formed in the reinforcement ring 5. Spring retainers 2*e* are coaxially secured to the ends of the spring retainer pins 2*r*, and slidably accommodated in recesses 6*h* formed in the die base 6**.

Springs **6*g* are accommodated in the recesses 6*h* to push the spring retainers 2*e* upward. By the biasing forces of the springs 6*g*, the movable die 2 is pushed up together with the spring retainer pins 2*r* and is held at a position where the spring retainers 2*e* are in contact with the bottom face of the reinforcement ring 5. A work kick-out pin 9 extends upward through a central bore or hole 6*k* formed in the die base 6 and also through the ironing die 4**.

For ironing the thread formation shaft portion wn of the work w with the ironing apparatus 1 as shown above, the thread formation shaft portion wn of the work w is inserted in the ironing die 4 by passing the cylindrical portion wk of the work w through the hole **2*k* of the movable die 2 with a head of the work w held in engagement with a dodecagonal trimming punch 7*c* of a lifting mechanism 7, as shown in FIG. 6(A). Then, the lifting mechanism 7 is lowered from this position to push down the movable die 2 together with the work w against the spring forces of the springs 6*g*, as shown in FIG. 6(B), so that the thread formation shaft portion wn of the work w is ironed by the ironing land. When the ironing process on the thread formation shaft portion wn is completed, the lifting mechanism 7 is raised, and the work w is kicked out from the ironing die 4 by the work kick-out pin 9**. The diameter of the ironed thread formation shaft portion wn is adjusted to a predetermined dimension.

In the above prior art ironing apparatus 1, however, the movable die 2 is moved vertically relative to the die case 8. Therefore, a predetermined clearance is formed between the movable die 2 and the die case 8. In addition, the cylindrical portion wk of the work w is inserted through the hole **2*k* of the movable die 2. Therefore, a predetermined clearance is also formed between the cylindrical portion wk of the work w and the wall surface of the hole 2*k***. The accumulation of these clearances has adverse effects of rattling of the work w when the thread formation shaft portion wn is ironed. It is thus difficult to stabilize the axial deflection accuracy (i.e., deflection of the head with reference to the thread portion) of the ironed work w for bolt to at least a predetermined level.

SUMMARY OF THE INVENTION

An object of the invention is to improve the axial deflection accuracy of the bolt by eliminating the clearance between the cylindrical portion of the work for bolt and the wall surface of the movable die hole, and to thereby permit the ironing of the thread formation shaft portion without adverse effects of rattling.

The above object of the invention is attained by a process of ironing a thread formation shaft portion of a work for bolt having a cylindrical portion and the thread formation shaft portion in axial alignment, which comprises the steps of supporting the cylindrical portion of the work in radial directions and in a zero clearance state, and moving the thread formation shaft portion in the axial direction relative to a shaft portion ironing die, the supporting step and the moving step being executed simultaneously.

In this process, the thread formation shaft portion of the work is ironed with the cylindrical portion thereof held continuously in radial directions and in a zero clearance state by a support member. No rattling is thus generated between the cylindrical portion of the work and the support member, and the axial deflection accuracy (i.e., deflection of the head with reference to the end thread portion) of the ironed work is improved.

Preferably, the cylindrical portion is supported in radial directions while it is ironed by a cylindrical portion ironing die.

The present invention will be more fully understood from the following detailed description and appended claims when taken with the accompanying drawings.

DETAILED DESCRIPTION OF THE PREFERRED EMBODIMENTS

First Embodiment

Figure 1A:
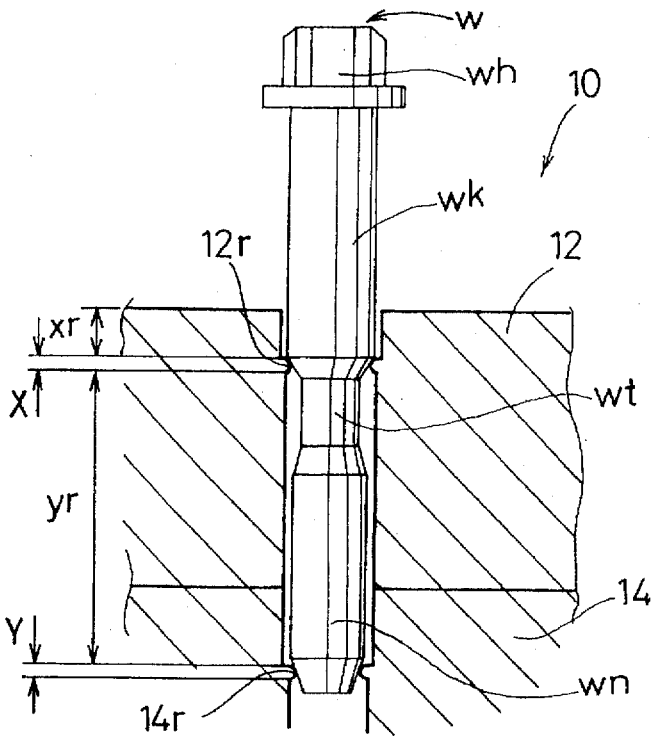
FIGS. 1(A) and 1(B) are sectional views showing part of a bolt work ironing apparatus according to a first embodiment of the invention.
Figure 1B:
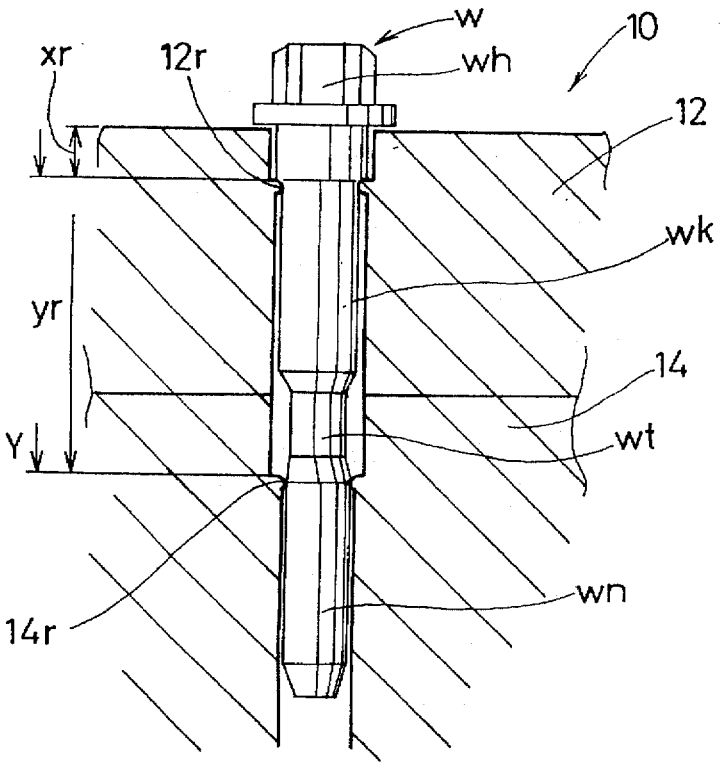
Figure 2:
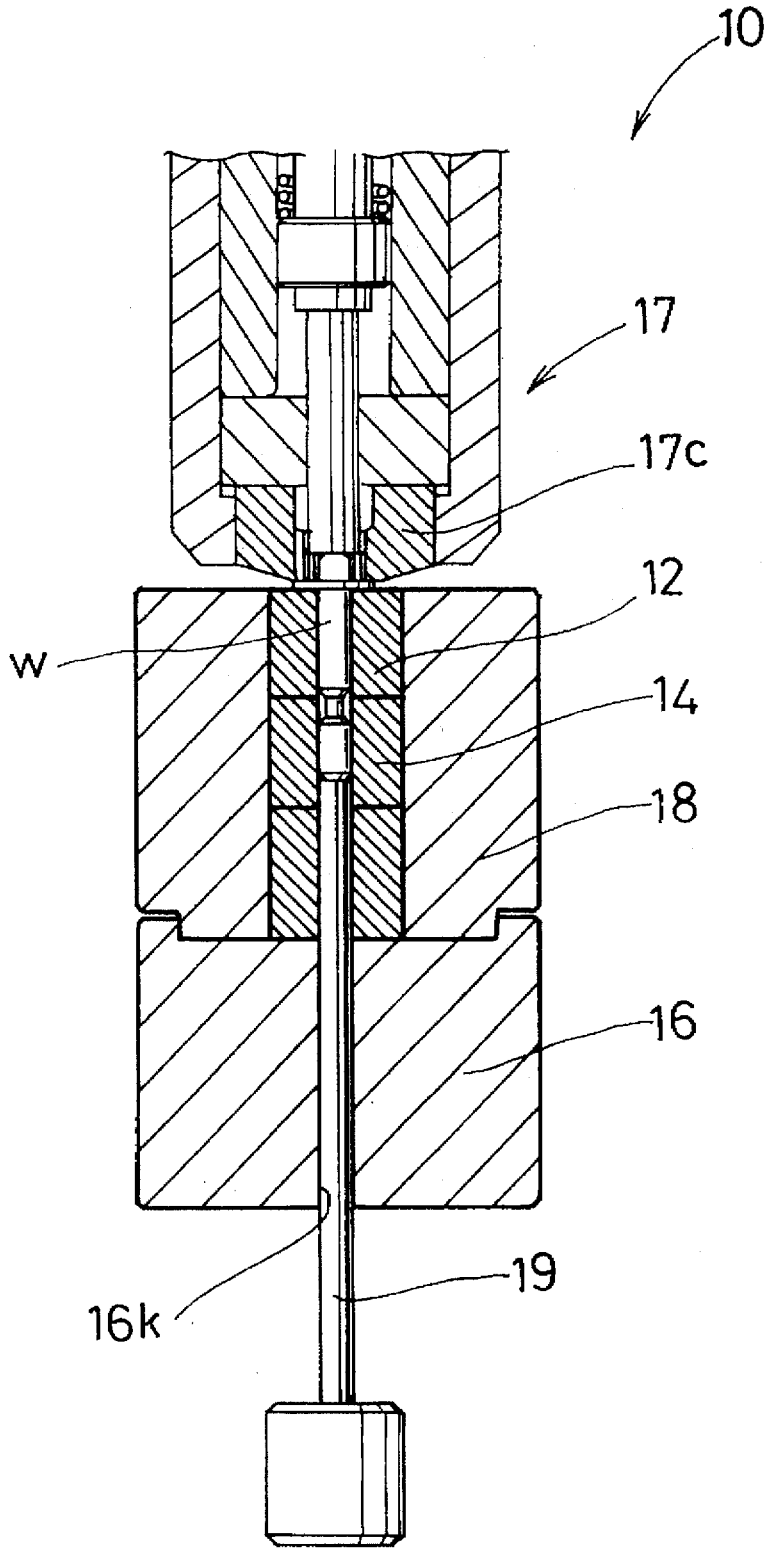
FIG. 2 is a sectional view showing the bolt work ironing apparatus according to the first embodiment of the invention.

Now, an ironing process and ironing apparatus according to a first embodiment of the invention will be described with reference to FIGS. 1(A), 1(B), 2, 3(A) to 3(C), 4(A) and 4(B). FIGS. 1(A) and 1(B) are fragmentary sectional views showing an ironing apparatus according to this embodiment, and FIG. 2 is a sectional view showing the whole ironing apparatus. FIG. 3(C) is a side view showing a thread formation shaft portion wn before being ironed, FIG. 3(B) is a side view showing the thread formation shaft portion wn after being ironed, and FIG. 3(A) is a side view showing a product bolt.

Figure 3A:
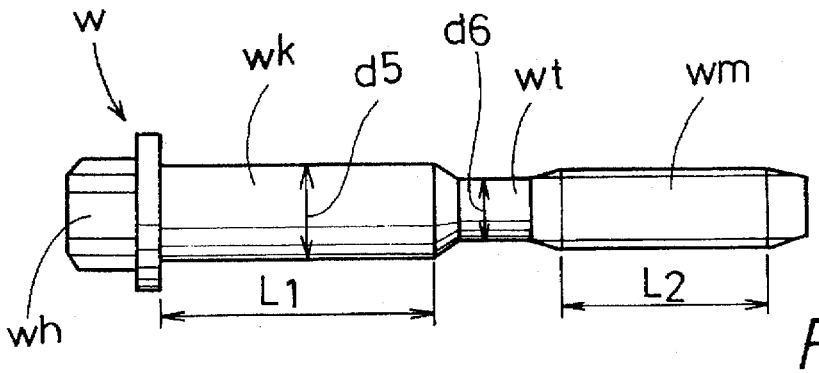
FIGS. 3(A) to 3(C) are schematic views showing a finished bolt, an ironed work for bolt, and a work for bolt before being ironed, respectively, according to the first embodiment.
Figure 3B:
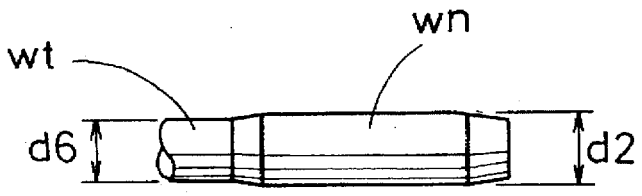
Figure 3C:
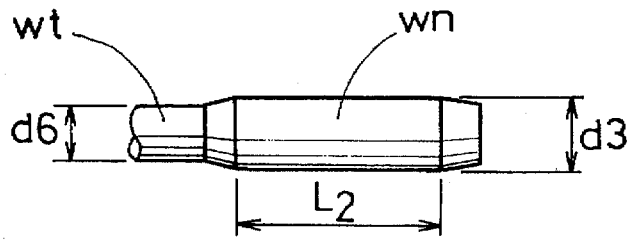

A work w for bolt which is to be processed, as shown in FIG. 3(A), has a head wh, a cylindrical portion wk, a connecting portion wt and a thread portion wm. Before the thread formation, the thread portion wm is swaged to increase its diameter to d3 (see FIG. 3(C)). It is then ironed by an ironing apparatus 10 according to the invention to reduce its diameter to d2 (see FIG. 3(B)). The ironed thread formation shaft portion wn is then formed with a thread in a subsequent step. The outer diameter d3 of the thread formation shaft portion wn before the ironing is set to be smaller than the outer diameter d5 of the cylindrical portion wk after being processed and greater than the outer diameter d6 of the connecting portion wt. A cylindrical portion ironing die to be described later has an inner diameter of d5, and the diameter d7 of the cylindrical portion before being processed is adjusted through the ironing to d5. Similarly, the diameter d3 of the thread formation shaft portion wn is adjusted through the ironing to d2, which is the inner diameter of a shaft portion ironing die. Naturally, d7>d5, and d3>d2. As noted above, d5>d3. Consequently, d7>d5>d3>d2. The length L2 of the thread formation shaft portion wn and the length L1 of the cylindrical portion wk are related as $$L1: L2+X+xr$$

where X is the land margin of an ironing land of a cylindrical portion ironing die 12 to be described later, and xr is the guide length of the cylindrical portion ironing die 12.

FIG. 2 shows the ironing apparatus 10, which is used for ironing the swaged thread formation shaft portion wn and comprises the cylindrical portion ironing die 12 and the shaft portion ironing die 14.

The cylindrical portion ironing die 12 supports the cylindrical portion wk of the work w for bolt in radial directions and in a zero clearance state when ironing the thread formation shaft portion wn of the work w. As shown in FIGS. 1(A) and 1(B), the die 12 has a land 12*r* formed at a predetermined upper position for ironing the cylindrical portion wk. The zone from the top of the cylindrical portion ironing die 12 to the land 12*r* serves as a guide for guiding the cylindrical portion wk of the work w down to the land 12*r*. This distance, i.e., the guide length, is xr. The land margin X is set to about 2 mm. The cylindrical portion ironing die 12 thus serves as a support member according to the invention.

The shaft portion ironing die 14 serves to iron the thread formation shaft portion wn of the work w. This die 14 is positioned coaxially to the cylindrical portion ironing die 12. It has a land 14*r* for ironing the thread formation shaft portion wn, and the land 14*r* is formed at a position at a distance yr from the land 12*r* of the cylindrical portion ironing die 12. The distance yr is set such that the leading end of the thread formation shaft portion wn reaches the land 14*r* when the leading end of the cylindrical portion wk clears the land 12*r*. The zone from the land 12*r* of the cylindrical portion ironing die 12 to the land 14*r* of the thread formation shaft portion 14 serves as a guide for guiding the thread formation shaft portion wn of the work w down to the land 14*r*.

The cylindrical portion ironing die 12 and shaft portion ironing die 14, as shown in FIG. 2, are accommodated in a coaxially superimposed state in a cylindrical die case 18. The die case 18, cylindrical portion ironing die 12 and shaft portion ironing die 14 are coaxially secured to a die base 16. A work kick-out pin 19 is disposed under the die base 16 and extends upward through a central hole 16*k* formed in the die base 16 and also through the shaft portion ironing die 14 and cylindrical portion ironing die 12.

An ironing process according to the invention will be described with reference to FIGS. 1(A), 1(B) and 2.

First, the lifting mechanism 17 is lowered to insert the work w, which is mounted vertically on a dodecagonal trimming punch 17*c* of the lifting mechanism 17, from the thread formation shaft portion wn through the cylindrical portion ironing die 12 and then the shaft portion ironing die 14. FIG. 1(A) shows the state in which the cylindrical portion wk of the work w has been led along the guide xr down to the land 12*r* and the thread formation shaft portion wn has been led along the guide yr down to the land 14*r*.

As the lifting mechanism 17 is further lowered form this state, ironing of the cylindrical portion wk of the work w by the land 12*r* is commenced, and slightly afterward, ironing of the thread formation shaft portion wn by the land 14*r* is commenced. When the work w is inserted through the ironing dies 12 and 14 to the extent that its head wh reaches the die 12, as shown in FIGS. 1(B) and 2, the ironing of the thread formation shaft portion wn and cylindrical portion wk are completed.

When the ironing of the thread formation shaft portion wn of the work w is thus completed, the lifting mechanism 17 is raised to detach the processed work w from the dodecagonal trimming punch 17*c*, and the work kick-out pin 19 is raised to kick out the work w from the cylindrical portion ironing die 12 and shaft portion ironing die 14.

When the ironing process is completed, an upper portion of the cylindrical portion wk remains without being ironed, as shown in FIG. 1(B). However, no problem arises so long as the cylindrical portion wk is ironed during ironing of the thread formation shaft portion wn because the cylindrical portion wk is ironed for the purpose of supporting the portion wk in radial directions in a rattling-free state (i.e., zero clearance state).

Since the cylindrical portion wk of the work w is supported in radial directions and in a zero clearance state by the cylindrical portion ironing die 12 while the thread formation shaft portion wn of the work w is ironed by the shaft portion ironing die 14, no rattling of the portion wk is caused, and the axial deflection accuracy (i.e., deflection of the head with reference to the end thread portion) of the ironed work w is improved.

Figure 4A:
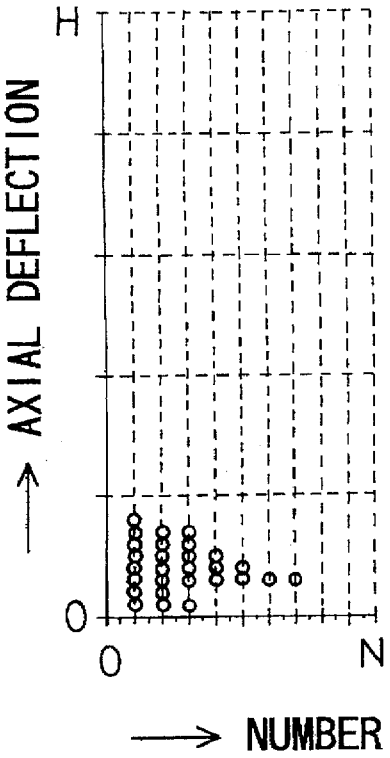
FIGS. 4(A) and 4(B) are a graph showing the axial deflection of work for bolt ironed by a bolt work ironing process according to the first embodiment of the invention and a graph showing the axial deflection of work for bolt ironed by a prior art bolt work ironing process.
Figure 4B:
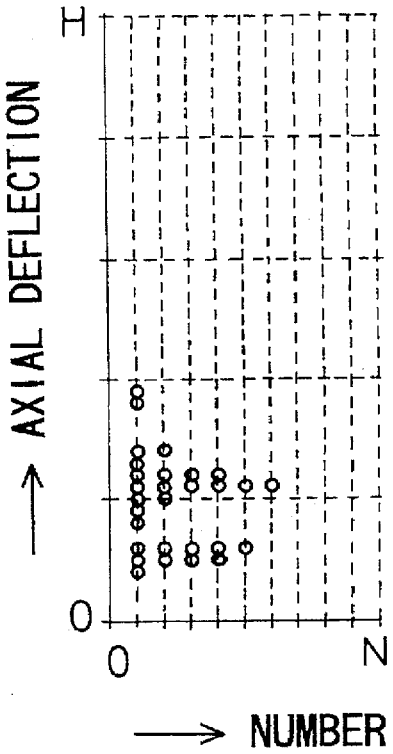

FIG. 4(A) is a graph showing the axial deflection of a plurality of works of bolt when the works are ironed in the ironing process according to this embodiment. FIG. 4(B) is a graph showing the axial deflection of a plurality of works w of bolt ironed in the prior art process. With the ironing process according to this embodiment, the axial deflection of the work w is reduced to about one half compared to the prior art.

Second Embodiment

Figure 5A:
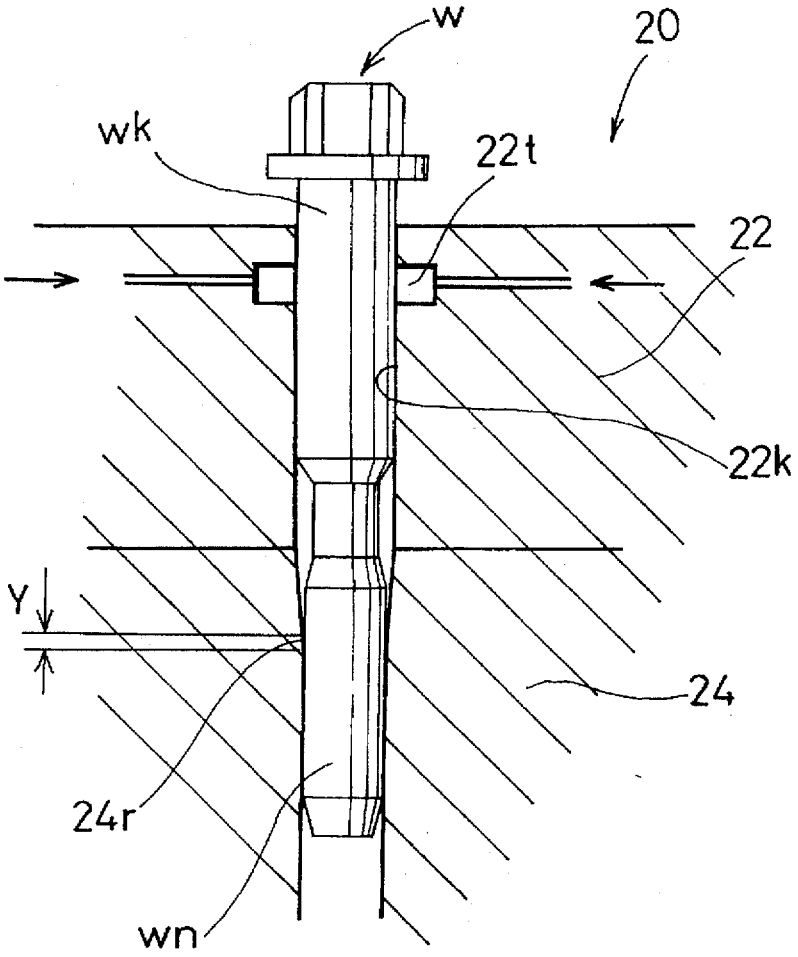
FIGS. 5(A) and 5(B) are sectional views showing a bolt work ironing apparatus according to a second embodiment of the invention.
Figure 5B:
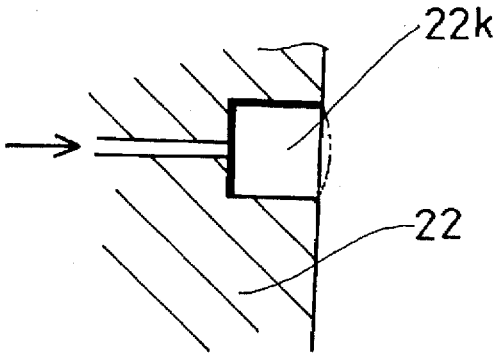
Figure 6A:
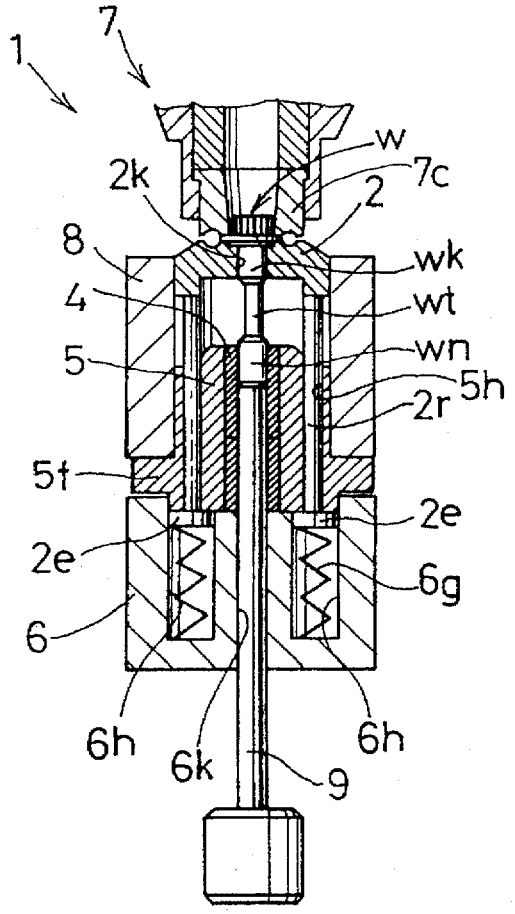
FIG.6(A) PRIOR ART
FIGS. 6(A) and 6(B) are sectional views showing a prior art ironing apparatus.
Figure 6B:
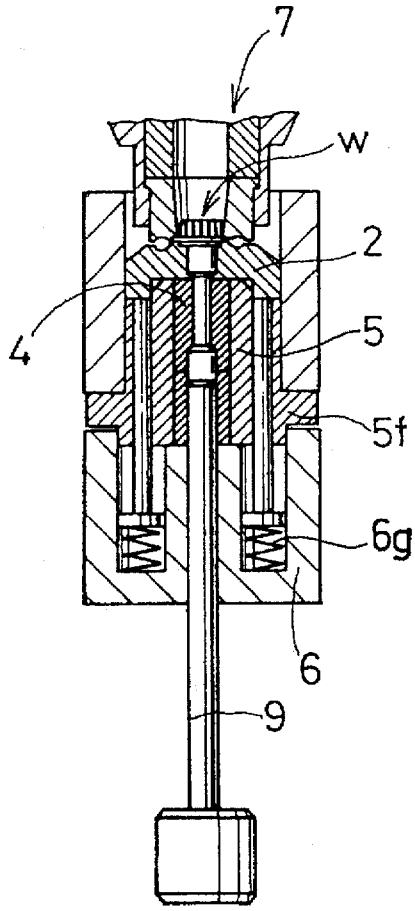
FIG.6(B) PRIOR ART

An ironing process and ironing apparatus according to a second embodiment of the invention will now be described with reference to FIGS. 5(A) and 5(B).

The ironing apparatus 20 according to this embodiment is an improvement of the cylindrical ironing die 12 in the ironing apparatus 10 according to the first embodiment. The construction is otherwise the same as the ironing apparatus 10 according to the first embodiment.

The ironing apparatus 20 comprises an upper support die 22 having a through hole **22*k* through which the work w for bolt is inserted. A ring-like oil hydraulic pressure chamber 22*t* is formed around the thorough hole 22*k*. The oil hydraulic pressure chamber 22*t* has a flexible side plate for forming a wall portion of the through hole 22*k*, so that, as shown in FIG. 5(B), the inner diameter of the thorough hole 22*k* is reduced when an oil hydraulic pressure is applied to the oil hydraulic pressure chamber 22*t*** from an oil hydraulic unit (not shown).

With this construction, the cylindrical portion wk of the work w is supported in radial directions and in a zero clearance state by the upper support die 22 when the thread formation shaft portion wn of the work w is ironed by the land **24*r* of the shaft portion ironing die 24**. The portion wk is thus free from rattling, and the axial deflection accuracy of the ironed work w is improved.

Thus, according to the invention, the cylindrical portion of the work for bolt is supported in radial directions and in a zero clearance state by the support member when the thread formation shaft portion of the work is ironed, thus eliminating rattling of the work and improving the axial deflection accuracy of the ironed work.

While the invention has been described with reference to preferred embodiments thereof, it is to be understood that modifications or variations may be easily made without departing from the scope of the present invention which is defined by the appended claims.

What is claimed is:

1. A process of ironing a thread formation shaft portion of a work for bolt having a cylindrical portion with a diameter d7 and a length L1 and the thread formation shaft portion with a diameter d3 and a length L2 in axial alignment, comprising steps of:

coaxially disposing a cylindrical portion ironing die with an inner diameter d5 and a shaft portion ironing die with an inner diameter d2; and axially moving the work from the cylindrical portion ironing die to the shaft portion ironing die with the thread formation shaft portion as the leading end, and wherein at the beginning of the axially moving step, ironing of the cylindrical portion of the work by the cylindrical portion ironing die is commenced before ironing of the thread formation shaft portion of the work by the shape portion ironing die;

the diameters d7 and d3 and the inner diameters d5 and d2 being set to be d7>d5>d3>d2.

2. An apparatus for ironing a thread formation shaft portion of a work for bolt having a cylindrical portion with a diameter d7 and the thread formation shaft portion with a diameter d3 in axial alignment, comprising:

a cylindrical portion ironing die with an inner diameter d5;

a coaxially disposed shaft portion ironing die with an inner diameter d2; and a lifting mechanism for axially moving the work from the cylindrical portion ironing die to the shaft portion ironing die with the thread formation shaft portion as the leading end, wherein the diameters d7 and d3 and the inner diameters d5 and d2 being set to be d7>d5>d3>d2, and wherein an axial distance between the cylindrical portion ironing die and the shaft portion ironing die is larger than the axial distance between front ends of the cylindrical portion and the thread formation shaft portion.

* * * * *